United States Patent [19]

Lustofin

[11] Patent Number: 4,982,472

[45] Date of Patent: Jan. 8, 1991

[54] DEVICE FOR CLEANING THE VINYL FILM LINER OF SWIMMING POOLS

[76] Inventor: Terry D. Lustofin, 17 Pine Hill Bend, Ballston Lake, N.Y. 12019

[21] Appl. No.: 395,543

[22] Filed: Aug. 18, 1989

[51] Int. Cl.[5] ..... A47L 13/46

[52] U.S. Cl. ..... 15/244.1; 15/119 A

[58] Field of Search ..... 15/116.2, 119 A, 145, 15/147 A, 244.1–244.4

[56] References Cited

U.S. PATENT DOCUMENTS

| | | | |
|---|---|---|---|
| 2,260,390 | 10/1941 | Lorenz | 15/147 A |
| 2,555,858 | 6/1951 | Olesky | 15/244.1 |
| 2,741,787 | 4/1956 | Palma, Jr. et al. | 15/244.1 |
| 2,769,549 | 11/1956 | Bixby | 15/145 |
| 2,955,309 | 10/1960 | Brown, Jr. | 15/119 A |
| 3,166,774 | 1/1965 | Blum | 15/119 A |
| 3,274,635 | 9/1966 | Myers | 15/244.2 |
| 3,570,038 | 3/1971 | Jones | 15/244.1 |
| 3,783,469 | 1/1974 | Siemund . | |
| 3,787,919 | 1/1974 | Siemund . | |
| 4,152,807 | 5/1979 | Smahlik . | |
| 4,317,250 | 3/1982 | Shutts . | |

FOREIGN PATENT DOCUMENTS

| | | | |
|---|---|---|---|
| 907779 | 3/1946 | France | 15/244.2 |
| 1075485 | 4/1954 | France | 15/119 A |
| 472880 | 7/1969 | Switzerland | 15/244.1 |

*Primary Examiner*—Philip R. Coe
*Assistant Examiner*—Mark Spisich
*Attorney, Agent, or Firm*—Norman B. Rainer

[57] ABSTRACT

A cleaning device is provided which is adapted to be removably attached to an extremity of an elongated manipulating handle and used for scrubbing a vinyl film liner of a swimming pool. The cleaning device has a rigid transverse member, and a post member which perpendicularly joins the transverse member at its mid-length and is adapted to attach to the manipulating handle. Resilient sponges of cylindrical shape are adhered onto the transverse member. In a preferred embodiment, collars are disposed upon the transverse member to prevent the sponges from bottoming out during use.

3 Claims, 1 Drawing Sheet

DEVICE FOR CLEANING THE VINYL FILM LINER OF SWIMMING POOLS

BACKGROUND OF THE INVENTION

This invention concerns a manually operable cleaning device positionable at an extremity of an elongated manipulating handle, and more particularly relates to a device for scrubbing an immersed vinyl film liner of a swimming pool.

Among the several varieties of swimming pools in general use, a popular type of construction for both in-ground and above-ground pools utilizes a flexible heavy gauge film applied to the interior surfaces of the pool to prevent egress of water. Such films, generally fabricated of plasticized polyvinyl chloride, have excellent retention of flexibility and are durable to sunlight exposure and the chemicals added to swimming pool water.

In the course of extended use, particularly in outdoor exposure, a build up of algea and sedimentary substances tends to accumulate upon the wall and bottom surfaces of swimming pools. Traditional tools for cleaning the immersed surfaces of the pool generally involve brushes adapted to be mounted at the lowermost extremity of a long straight pole. Although suitable on concrete or tile-walled swimming pool surfaces, the brushes tend to produce streaked results on vinyl liners and may even damage the liner. It has also been found that the brushes cannot accommodate to the corners and various contours of the pool surfaces.

Cleaning devices utilizing synthetic sponge materials have been tried in cleaning swimming pool surfaces. Although they conform well to surface irregularities and contour variations, most sponge materials compact or "bottom out" when excessive force is applied to them. This is particularly true when the bottom surface of the pool is being scrubbed, where considerable force is needed to maintain the tool in firm contact with the bottom surface.

It is accordingly an object of the present invention to provide a device for cleaning vinyl liners disposed upon the interior surfaces of swimming pools.

It is another object of this invention to provide a device as in the foregoing object which utilizes synthetic sponge members.

It is a further object of the present invention to provide a device of the aforesaid nature which may be attached to the lower extremity of a long manipulative pole.

It is yet another object of the present invention to provide a device of the aforesaid nature of rugged, durable construction amenable to low cost manufacture.

These objects and other objects and advantages of the invention will be apparent from the following description.

SUMMARY OF THE INVENTION

The above and other beneficial objects and advantages are accomplished in accordance with the present invention by a cleaning device comprising:

(a) a straight rigid transverse member having a circular cylindrical configuration elongated between two opposed extremities, (b) a post member which perpendicularly joins said transverse member at a site midway between said extremities, thereby defining half lengths of said transverse member extending between said site of joinder and respective extremity, and (c) two identical resilient sponges each disposed upon a half length and held thereupon by waterproof adhesive, each sponge having a circular cylindrical outer configuration terminating in two end faces perpendicularly disposed to the center axis of said cylindrical outer configuration, and an internal bore of circular cylindrical configuration disposed upon said axis and opening upon one of said end faces, the openings of said two sponges being in facing relationship, the length of said bore being sufficient to accommodate the respective half length, and the diameter of said bore being approximately the same as the diameter of the respective half length, thereby providing adequate surface contact to ensure secure adhesive joining of the sponge upon the half length.

In a preferred embodiment, a collar is positioned upon each half length about midway thereof, said collars being identical and each having two opposed substantially flat surfaces perpendicularly oriented to the cylindrical surface of the half length and having a circular perimeter disposed in coaxial relationship with said half length. In said preferred embodiment, the two identical sponges are disposed upon the half lengths in a manner whereby the end faces upon which the bore opens lie in abutment with said collars, and a third sponge is disposed upon said traverse member between said two identical sponges, and in abutment with said collars. The diameter of the collars is slightly smaller than the cylindrical diameters of the respective sponges. By virtue of such arrangement, the sponges are prevented from compacting or "bottoming out".

BRIEF DESCRIPTION OF THE DRAWING

For a fuller understanding of the nature and objects of the invention, reference should he had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
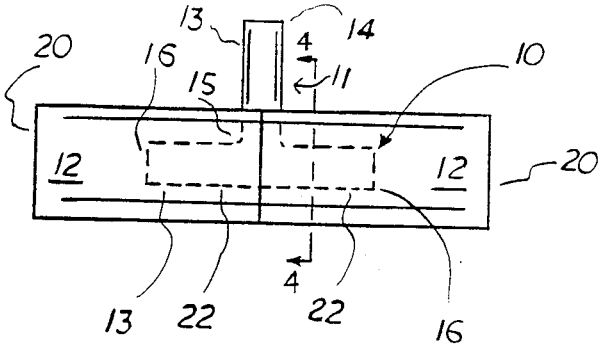
FIG. 1 is a front view of an embodiment of the cleaning device of the present invention.
Figure 2:
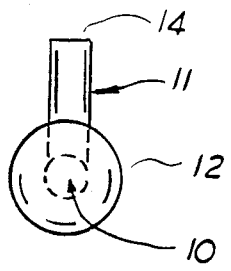
FIG. 2 is an end view of the embodiment of FIG. 1.

Referring to FIGS. 1 and 2, an embodiment of the present invention is shown comprised of a straight rigid transverse member 10 bisected by post member 11 and accommodating identical resilient sponges 12.

The transverse and post members may be fabricated of solid or tubular metal such as aluminum, or rigid plastic such as polyvinylchloride, acrylonitrile-butadiene-styrene interpolymers, and equivalent synthetic thermoplastic polymers, or fiberglass-reinforced thermoset polymers. The exemplified transverse and post members have circular cylindrical outer surfaces 13.

Post member 11 is elongated between an upper extremity 14 adapted to attach to a conventional manipulating pole, and a lower extremity 15 which joins transverse member 10.

Transverse member 10 extends between opposed extremities 16. The portion of transverse member extending between an extremity 16 and the mid-point where joinder occurs with the post member, is defined as a half length 22 of the transverse member.

The sponges, which may be fabricated of polyurethane, polystyrene, polyethylene, or cellulose have circular cylindrical outer surfaces 18, and terminate in end faces 19 and 20 perpendicularly disposed to the center axis 23 of said outer surfaces 18. The sponges have an internal bore 21 of circular cylindrical configuration disposed upon axis 23 and opening upon face 19. The diameter of the bore is approximately the same as or slightly smaller than the diameter of the half lengths 22, thereby enabling the sponges to be adhesively joined to the half lengths.

Figure 4:
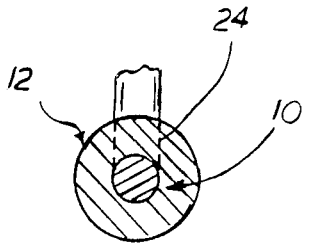
FIG. 4 is a sectional view taken upon the line 4—4 of FIG. 1.

When the two identical sponges 12 are pushed onto half lengths 22, faces 19 are in contacting abutment. It is to be noted that the length of bores 21 should be great enough to accommodate the half length of the transverse member. A radially disposed recess 24, as shown in FIG. 4, may be incorporated into face 19 to accommodate post member 11.

Figure 3:
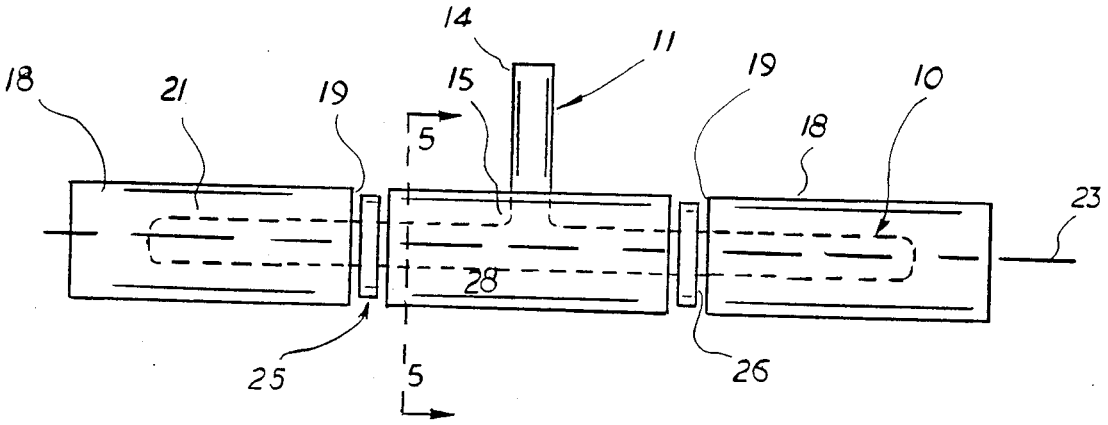
FIG. 3 is a front view of an alternative embodiment of the present invention.
Figure 5:
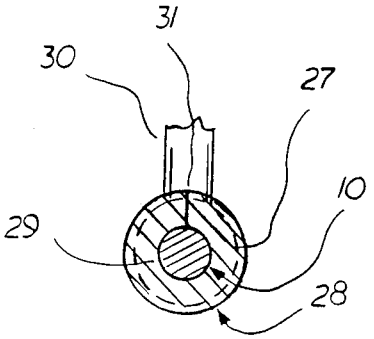
FIG. 5 is a sectional view taken upon the line 5—5 of FIG. 3.

In the alternative embodiment exemplified in FIG. 3, a collar 25 having a circular perimeter 27 is positioned upon each half length 22 about midway thereof. The illustrated collars are identical, each having two opposed substantially flat surfaces 26 perpendicularly oriented to axis 23. The diameter of perimeter 27 is less than the diameter of identical sponges 12. In said alternative embodiment, sponges 12 are disposed upon the half lengths in a manner whereby end faces 19 lie In abutment with flat surfaces 26. A third sponge 28 is disposed upon transverse member 10 between identical sponges 12, and in abutment with said collars. As shown in FIG. 5, said third sponge is penetrated by axial channel 29, and perpendicular channel 30 which embraces post member 11. Sponge 28 is provided with slit 31 disposed in a plane containing the axes of channels 29 and 30, said slit extending from the outer surface of the sponge to channel 29. By virtue of such slit, sponge 28 can be emplaced upon the transverse and post members.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A cleaning device adapted to be removably positioned at an extremity of an elongated manipulating handle for scrubbing a vinyl film liner of a swimming pool, said cleaning device comprising:

(a) a straight rigid transverse member having a circular cylindrical configuration elongated between two opposed extremities.

(b) a post member which perpendicularly joins said transverse member at a site midway between said extremities, thereby defining half lengths of said transverse member extending between said site of joinder and respective extremity, (c) two identical resilient sponges each disposed upon a half length and held thereupon by waterproof adhesive, each sponge having a circular cylindrical outer configuration terminating in two end faces perpendicularly disposed to the center axis of said cylindrical outer configuration, and an internal bore of circular cylindrical configuration disposed upon said axis and opening upon one of said end faces, the openings of said two sponges being in facing relationship, the length of said bore being sufficient to accommodate the respective half length, and the diameter of said bore being approximately the same as the diameter of the respective half length, thereby providing adequate surface contact to ensure secure adhesive joining of the sponge upon the half length, and (d) a collar positioned upon each half length at a position between a respective sponge and the post member, said collars being identical and having two opposed substantially flat surfaces perpendicularly oriented to the cylindrical surface of the half length and having a circular perimeter disposed in coaxial relationship with said half length, the diameter of said circular perimeter being slightly smaller than the cylindrical diameter of the sponge.

2. The cleaning device of claim 1 wherein the two identical sponges are disposed upon the half lengths in a manner whereby the end faces upon which the bores open lie close to said collars, and a third sponge is disposed upon said transverse member between said two identical sponges.

3. The cleaning device of claim 1 wherein said post member is adapted to removably attach to an extremity of said manipulating handle.

* * * * *